US008491086B2

(12) United States Patent
Gila et al.

(10) Patent No.: US 8,491,086 B2
(45) Date of Patent: Jul. 23, 2013

(54) HARD IMAGING DEVICES AND HARD IMAGING METHOD

(75) Inventors: Omer Gila, Cupertino, CA (US); Napoleon J. Leoni, San Jose, CA (US); Michael H. Lee, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/262,605

(22) PCT Filed: Apr. 1, 2009

(86) PCT No.: PCT/US2009/039150
§ 371 (c)(1),
(2), (4) Date: Sep. 30, 2011

(87) PCT Pub. No.: WO2010/114534
PCT Pub. Date: Oct. 7, 2010

(65) Prior Publication Data
US 2012/0019589 A1 Jan. 26, 2012

(51) Int. Cl.
*B41J 2/165* (2006.01)

(52) U.S. Cl.
USPC ..... 347/22

(58) Field of Classification Search
None
See application file for complete search history.

(56) References Cited

U.S. PATENT DOCUMENTS

| | | | | |
|---|---|---|---|---|
| 5,298,926 | A * | 3/1994 | Fukushima et al. | 347/34 |
| 5,774,141 | A * | 6/1998 | Cooper et al. | 347/34 |
| 5,896,148 | A * | 4/1999 | Fukushima et al. | 347/67 |
| 7,632,533 | B2 | 12/2009 | Fotland et al. | |
| 2007/0046764 | A1 * | 3/2007 | Nakazawa | 347/224 |
| 2008/0018707 | A1 * | 1/2008 | Masuyama et al. | 347/55 |

FOREIGN PATENT DOCUMENTS

| | | |
|---|---|---|
| GB | 2324765 | 11/1998 |

* cited by examiner

*Primary Examiner* — Matthew Luu
*Assistant Examiner* — Michael Konczal

(57) ABSTRACT

Hard imaging devices and methods are described. According to one arrangement, a hard imaging device includes a media transport system configured to move media along a media path and a print device adjacent to the media path and configured to eject a plurality of droplets of a liquid marking agent in a direction towards the media moving along the media path to form hard images using the media. The ejection of the droplets of the liquid marking agent by the print device creates satellites of the liquid marking agent suspended in air in a region adjacent to the print device and the media. The device also includes a satellite removal system in one arrangement to remove the satellites from the air in the region adjacent to the print device and the media.

16 Claims, 5 Drawing Sheets

HARD IMAGING DEVICES AND HARD IMAGING METHOD

FIELD OF THE DISCLOSURE

Aspects of the disclosure relate to hard imaging devices and hard imaging methods.

BACKGROUND

Imaging devices capable of printing images upon paper and other media are ubiquitous and used in many applications including monochrome and color applications. The use and popularity of these devices continues to increase as consumers at the office and home have increased their reliance upon electronic and digital devices, such as computers, digital cameras, telecommunications equipment, etc.

A variety of methods of forming hard images upon media exist and are used in various applications and environments, such as home, the workplace and commercial printing establishments. Some examples of devices capable of providing different types of printing include laser printers, impact printers, inkjet printers, commercial digital presses, etc.

Some configurations of printers which use liquid marking agents may be subjected to contamination by satellites formed during printing operations. For example, in some inkjet configurations, the jetting of drops of a liquid marking agent may also result in the formation of satellites of the liquid marking agent which may contaminate media being imaged upon, nozzles, or other equipment of the printer.

DESCRIPTION OF DRAWINGS

At least some aspects of the disclosure are directed towards improved imaging methods and apparatus.

FIG. 4 is an illustrative representation of a print device according one embodiment.

DETAILED DESCRIPTION

Hard imaging devices, such as printers, may be subjected to contamination during imaging operations. For example, some printer inkjet configurations eject droplets of a liquid marking agent (e.g., ink) to form hard images upon media. The ejection of the droplets may result in the creation of satellites of the liquid marking agent which may contaminate media being imaged upon or imaging components of the hard imaging devices. This contamination may degrade the print quality of the hard imaging device. At least some aspects of the disclosure are directed towards methods and apparatus configured to reduce contamination caused by satellites of the liquid marking agent.

Figure 1:
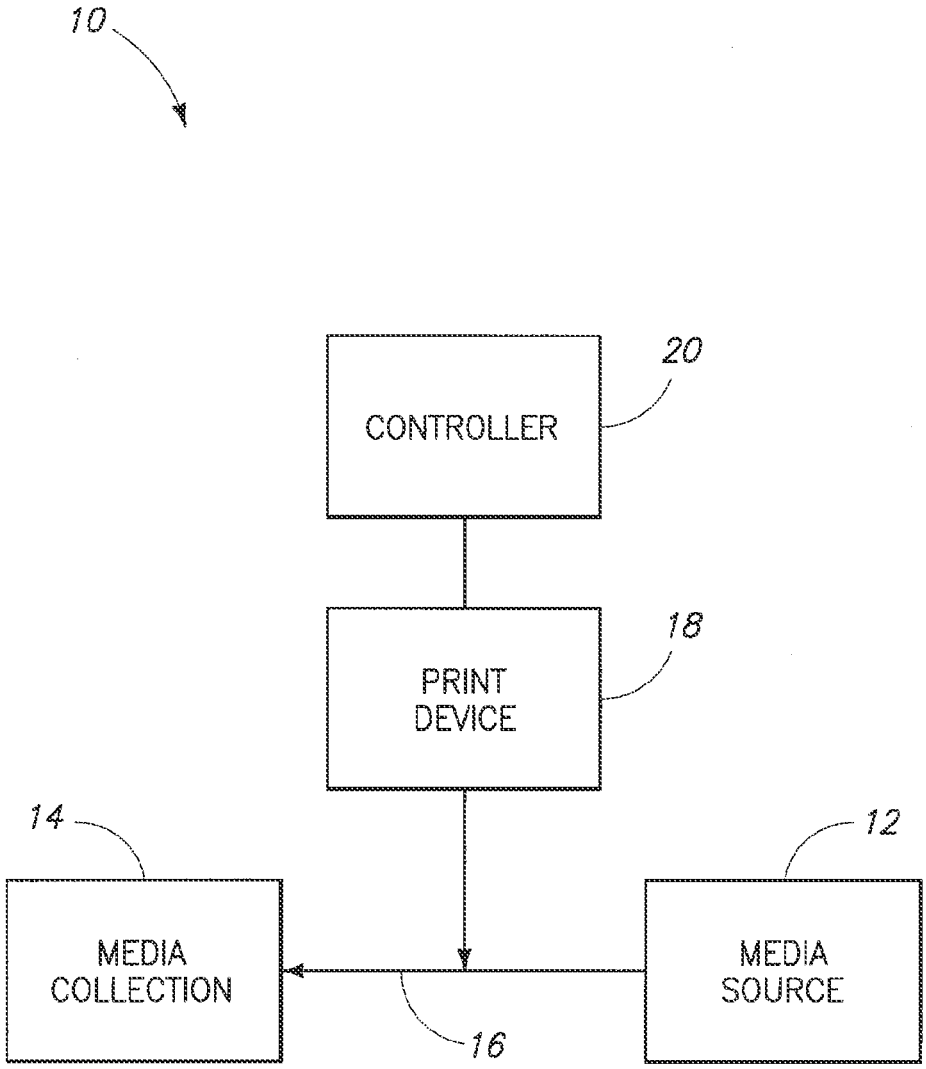
FIG. 1 is a functional block diagram at a hard imaging device according to one embodiment.

Referring to FIG. 1, an example of a hard imaging device 10 arranged according to one embodiment of the disclosure is shown. Hard imaging device 10 is configured to form hard images upon media. Example embodiments of the hard imaging device 10 include printers although other hard imaging device configurations are possible including copiers, multiple-function devices, or other arrangements configured to form hard images upon media.

The depicted embodiment of hard imaging device 10 includes a media source 12, a media collection 14, a media path 16, a print device 18 and a controller 20. Other embodiments of hard imaging device 10 are possible and include more, less or additional components.

In one embodiment, media source 12 comprises a supply of media to be used to form hard images. For example, media source 12 may be configured as a roll of web media or a tray of sheet media, such as paper. Other media or configurations of media source 12 may be used in other embodiments.

Media travels in a process direction along the media path 16 from media source 12 to media collection 14 in example embodiments. Hard images are formed using media travelling along the media path 16 intermediate the media source 12 and media collection 14 in example configurations described below.

Media collection 14 is configured to receive the media having hard images formed thereon following printing. Media collection 14 may be configured as a take-up reel to receive web media or a tray to receive sheet media in example embodiments.

Media source 12 and media collection 14 may form a media transport system in one embodiment of hard imaging device 10 (e.g., comprising supply and take-up reels for web media) configured to move the media along the media path 16. In another embodiment of hard imaging device 10 (e.g., sheet media), the media transport system may comprise a plurality of rollers (not shown) to move media from media source 12 to media collection 14.

Print device 18 is configured to provide one or more liquid marking agents to media travelling along media path 16 to form the hard images in one embodiment. In one embodiment, the liquid marking agents may include one or more colors of inks. Different types of inks, such as aqueous, solvent or oil based, may be used depending upon the configuration of the hard imaging device 10. Furthermore, the liquid marking agents may include a fixer or binder, such as a polymer, to assist with binding inks to the media and reducing penetration of the inks into the media. In one embodiment, print device 18 comprises an inkjet print head (e.g., piezo, thermal, etc.) configured to eject a plurality of droplets of the liquid marking agent corresponding to an image to be formed. Hard imaging device 10 may be configured to generate color hard images in one embodiment, and print device 18 may include a plurality of pens (not shown in FIG. 1) configured to provide droplets of the liquid marking agent having different colors (e.g., different colored inks) and fixers or binders (if utilized). Other arrangements of print device 18 are possible.

In one embodiment, controller 20 is arranged to process data (e.g., access and process digital image data corresponding to a color image to be hard imaged upon media), control data access and storage, issue commands, monitor imaging operations and control imaging operations of hard imaging device 10. In one embodiment, controller 20 is arranged to control operations described herein with respect to removal of satellites of the liquid marking agent generated during imaging operations. In one arrangement, the controller 20 comprises circuitry configured to implement desired programming provided by appropriate media in at least one embodiment. For example, controller 20 may be implemented as one or more of a processor and/or other structure configured to execute executable instructions including, for example, software and/or firmware instructions, and/or hardware circuitry. Example embodiments of controller 20 include hardware logic, PGA, FPGA, ASIC, state machines, and/or other structures alone or in combination with a processor. These examples of controller 20 are for illustration and other configurations are possible.

Figure 2:
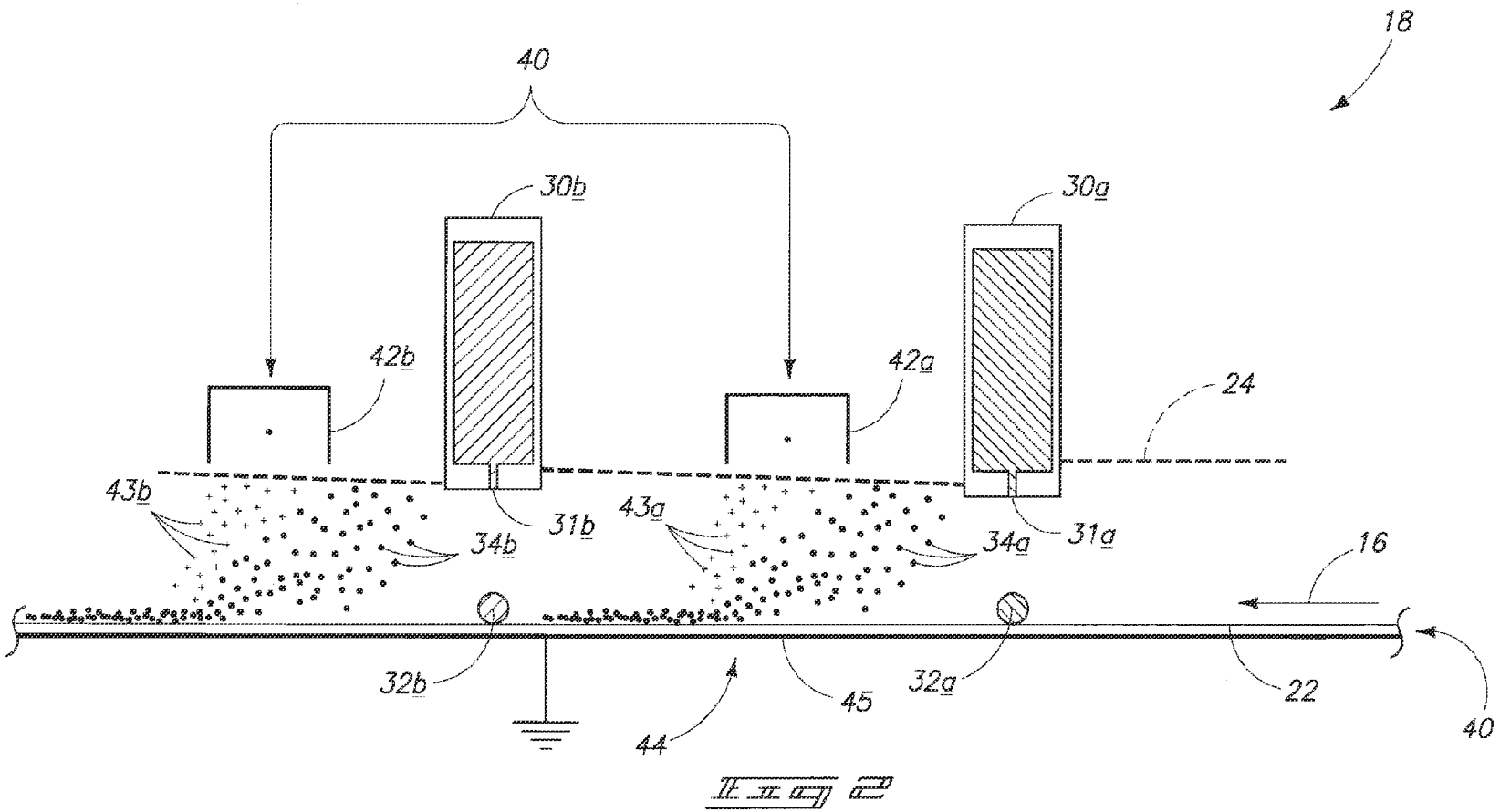
FIG. 2 is an illustrative representation of a print device according one embodiment.

Referring to FIG. 2, one embodiment of print device 18 configured as an inkjet printhead configured to form color hard images is shown. The print device 18 is configured to form hard images upon media 22 travelling along media path 16 as shown. The movement of media 22 travelling along media path 16 generates an air boundary 24 generally corresponding to a boundary where air below the boundary 24 moves with the media 22 in the direction of travel of the media 22 along the media path 16 while air above the boundary 24 is not significantly affected by the travelling media 22.

Print device 18 includes a plurality of pens 30*a*, 30*b* in the depicted arrangement configured to form hard color images. Other arrangements of print device 18 include a single pen 30 configured to eject a marking agent having a single color for monochrome applications. Pens 30*a*, 30*b* include respective nozzles 31*a*, 31*b* which are configured to eject droplets 32*a*, 32*b* of the liquid marking agent toward media 22 moving along media path 16. In the described embodiment, pens 30*a*, 30*b* are configured to eject the droplets 32*a*, 32*b* comprising different colors of ink (e.g., cyan, magenta, yellow, or black). Print device 18 may include additional pens to eject droplets of marking agent of additional colors and/or fixers or binders in some embodiments.

In the depicted embodiment, the pens 30*a*, 30*b* are arranged in series one after another to eject the droplets 32*a*, 32*b* upon media 22 moving along paper path 16 to form color images in a single pass of the media 22 adjacent to print device 18. In other embodiments, the different colors may be deposited upon media 22 in a plurality of passes of the media 22 adjacent to the print device 18. In yet an additional embodiment, print device 18 only includes a single pen to form black and white images. In one embodiment, nozzles 31*a*, 31*b* are spaced a desired distance (e.g., 0.5 mm-1.0 mm) from media 22.

FIG. 2 shows droplets 32*a*, 32*b* of liquid marking agent upon media 22. The ejection of droplets 32*a*, 32*b* by pens 30*a*, 30*b* to form hard images upon media 22 generates plural satellites 34*a*, 34*b* of the respective different colors of the liquid marking agent. In particular, droplets 32*a*, 32*b* may individually have an elongated shape as they are ejected from nozzles 31*a*, 31*b* due to adhesion forces between the ejected liquid marking agent and the nozzles 31*a*, 31*b*. The heads of the droplets 32*a*, 32*b* may move at a faster rate away from pens 30*a*, 30*b* compared with the tail portions of the droplets 32*a*, 32*b* which may lose their initial speed breaking away from the droplets 32*a*, 32*b* and creating the satellites 34*a*, 34*b*. The satellites 34*a*, 34*b* are relatively small and light aerosol droplets compared with the ejected droplets 32*a*, 32*b* and may remain suspended in a region of air adjacent to media 22 and downstream of the pens 30*a*, 30*b* while droplets 32*a*, 32*b* continue to move downward to the media 22. In one embodiment, the droplets 32*a*, 32*b* individually have a diameter of approximately 12-50 microns and a volume between 1 to 50 pL while the satellites individually have a diameter of approximately 1-10 microns and a volume of approximately 0.01 to 0.3 These satellites 34*a*, 34*b* may land upon various components of the print head 18 of the hard imaging device 10 (such as pens 30*a*, 30*b*) and/or media 22. Satellites 34*a*, 34*b* landing upon the pens 30*a*, 30*b* or media 22 may degrade the print quality of hard images being formed upon media 22.

According to some embodiments described herein, hard imaging device 10 includes a satellite removal system 40 configured to remove the satellites 34*a*, 34*b* which are suspended in a region of air about pens 30*a*, 30*b*. In one embodiment, satellite removal system 40 is configured to generate a flux of charges providing an electric field to remove the satellites 34*a*, 34*b*. The satellites 34*a*, 34*b* are electrically charged by the flux of charges and the charged satellites 34*a*, 34*b* are directed away from the region of air about pens 30*a*, 30*b* by the electrical field in one embodiment.

Referring to the example arrangement shown in FIG. 2, the satellite removal system 40 includes a plurality of sources 42*a*, 42*b* configured to create the electrical field and a target 44. In the depicted embodiment, sources 42*a*, 42*b* may be referred to as charge injectors (e.g., coronas, Scorotrons, charge rollers, needles, edges) and are configured as positive charging devices which individually emit a stream of positively charged ions 43*a*, 43*b* to provide an electrical field, charge satellites 34*a*, 34*b* and direct the charged satellites 34*a*, 34*b* to target 44. Charge emitting portions of sources 42*a*, 42*b* are provided approximately 2-6 mm above the surface of media 22 in one embodiment. Charge emitting portions of sources 42*a*, 42*b* may be provided at substantially the same elevation as nozzles 31*a*, 31*b* in another embodiment (e.g., 0.5-1 mm above the surface of media 22).

In the illustrated example embodiment, target 44 is implemented as a grounded structure 45 configured to receive the emitted charged ions. In one embodiment, grounded structure 45 is implemented as a conductive plate adjacent to the media path 16 and media 22. In some arrangements, media 22 travelling along media path 16 is spaced from the grounded conductive plate (e.g., spaced by a distance of approximately 0.4 mm-1 mm) to avoid abrasion of media 22 and/or damage to images which may be formed on the lower surface of media 22 in FIG. 2. In another embodiment, the grounded structure 45 is implemented as a plurality of grounded conductive rollers (not shown) which contact and move with media 22 travelling along the media path 16. In one more specific example, the grounded conductive rollers are provided corresponding to respective ones of the pens 30*a*, 30*b* and are positioned in alignment with the pens 30*a*, 30*b*. Other configurations of target 44 are possible.

In the depicted embodiment, the positively charged ions emitted from sources 42*a*, 42*b* are attracted to target 44. While travelling along field lines intermediate the sources 42, 42*b* and target 44, the ions positively charge the satellites 34*a*, 34*b* which are subsequently attracted to the grounded target 44. The generated electrical field directs the electrically charged satellites 34*a*, 34*b* downward towards the target 44 and the satellites 34*a*, 34*b* and upon the media 22 as shown in FIG. 2 which operates to remove the satellites 34*a*, 34*b* which were suspended in air from an imaging region above the media 22 and adjacent to pens 30*a*, 30*b*. In illustrative examples, the sources 42*a*, 42*b* implemented as positive coronas have operational voltages of approximately 3 kV if the media 22 contacts the target 44 and approximately 5-8 kV if the media 22 is spaced approximately 0.5-1.0 mm from the target 44. Other arrangements are possible.

As discussed above in one embodiment, the sources 42*a*, 42*b* are configured to emit streams of positively-charged ions which are attracted to the grounded target 44. Sources 42*a*, 42*b* may be configured to emit negatively charged ions and target 44 may be provided at a positive voltage to attract the negatively charged ions and satellites 34*a*, 34*b* charged thereby in another embodiment.

In one embodiment using negatively charged ions, an ozone removal system (not shown) may be used to remove ozone generated during the emission of the negative ions from sources 42*a*, 42*b* (e.g., using suction to remove the ozone). Typical charge fluxes of sources 42*a*, 42*b* implemented as negative coronas provide approximately $10^{12}$ electrons per $cm^2$ of the media 22 for a typical process speed of print device 18 of approximately 1~2 m/s compared with approximately 40% of the number for positive coronas. Use of negative coronas provides charging of an individual satellite 34*a*, 34*b* with approximately 10,000 e. However, positive coronas provide charges of increased uniformity compared with negative coronas. In one arrangement, sources 42*a*, 42*b* configured as coronas individually have a current of approximately 2 mA/meter and about 16 watts/meter of width.

The velocity of ions (~10^3 mils) emitted by sources 42*a*, 42*b* is large compared with air speed corresponding to the movement of media 22 along path 16 (e.g., 1~2 m/s) and velocity of ejected droplets 32*a*, 32*b* (approximately $10^5$ cm/s). This provides a velocity of charged satellites 34*a*, 34*b* of approximately 10 m/s when a negative corona is used or 4 m/s if a positive corona is used. For satellites 34*a*, 34*b* having a diameter of approximately 1 micron, the ratio of achieved electrostatic forces on the satellites 34*a*, 34*b* compared to air drag forces is approximately 10 for a negative corona and approximately 4 for a positive corona providing quick removal of satellites 34*a*, 34*b* from the air region about the pens 30*a*, 30*b*.

In this example embodiment, satellite removal system 40 is configured to reduce cross-contamination between pens 30*a*, 30*b*. For example, source 42*a* is configured to emit the charged ions 43*a* to charge and remove satellites 42*a* from the region of air intermediate the pens 30*a*, 30*b* and before the satellites 42*a* can contaminate pen 30*b* downstream from pen 30*a*.

Figure 3:
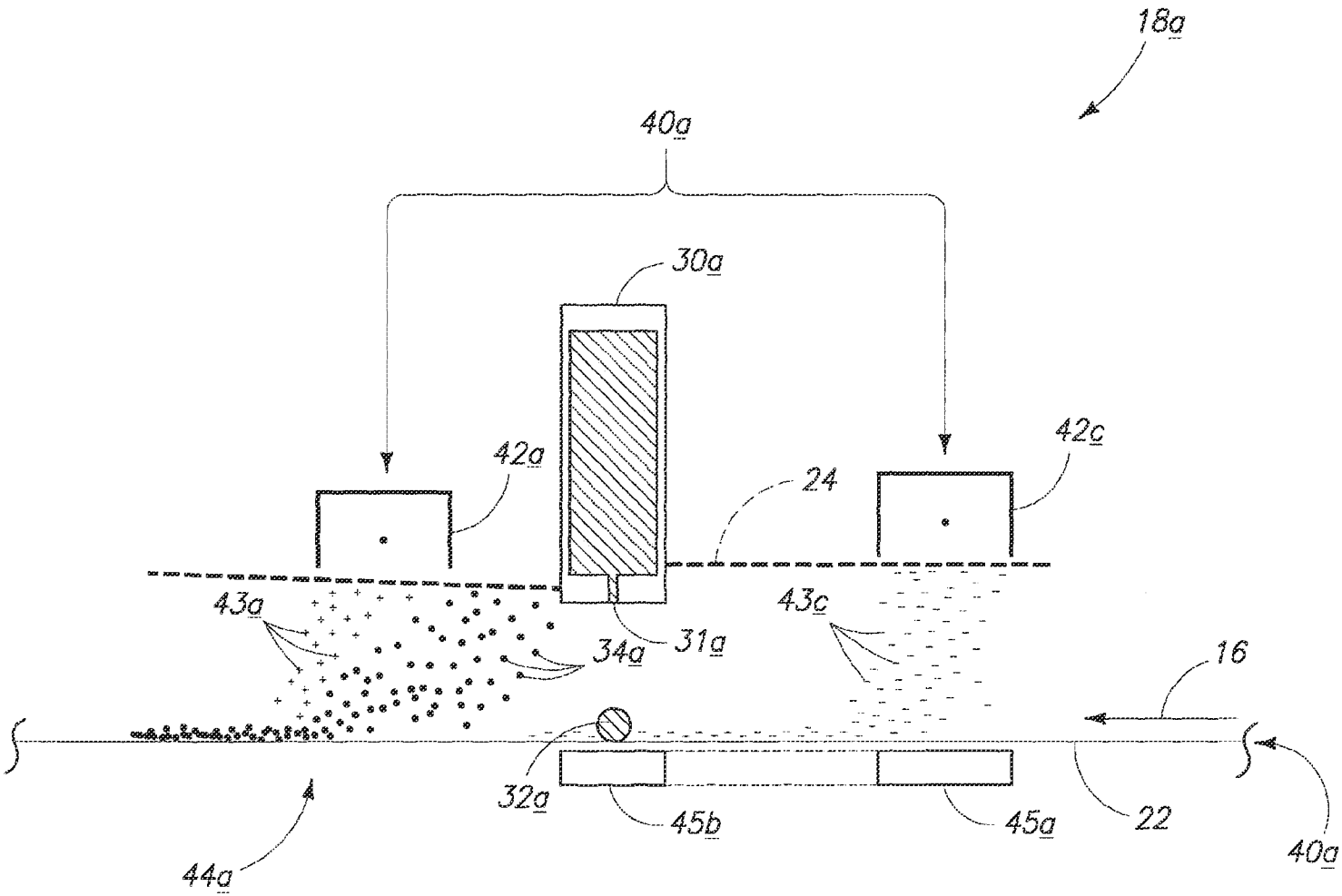
FIG. 3 is an illustrative representation of a print device according one embodiment.
Figure 11:
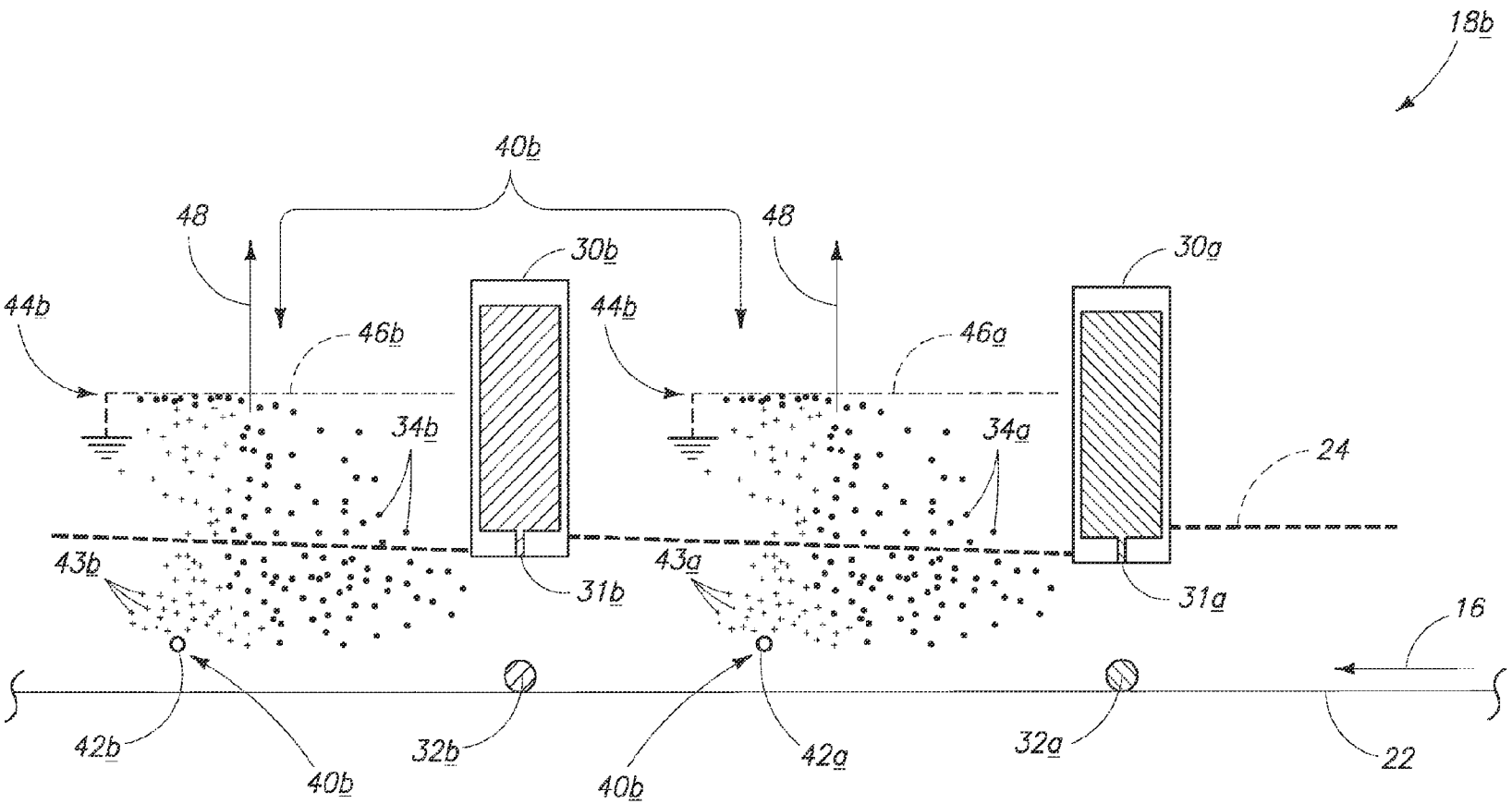

Referring to FIG. 3, another embodiment of print device 18*a* is shown. Print device 18*a* includes another embodiment of satellite removal system 40*a* configured to remove satellites 34*a* suspended in the air and resulting from the ejection of droplets 32*a* from nozzle 31*a*. Additional pens to provide droplets of liquid marking agent are not shown in FIG. 3 but may be provided in some arrangements.

In the illustrated embodiment, satellite removal system 40*a* comprises another source 42*c* in addition to source 42*a*. Source 42*c* has a polarity opposite to the polarity of source 42*a* and is configured to provide an electrical field with respect to a grounded structure 45*a* to electrically charge media 22 travelling along the media path 16. In one example, source 42*c* is configured to emit negatively charged ions which negatively charge media 22 providing target 44*a* which attracts satellites 34*a* which have been positively charged by positively charged ions 43*a* emitted from source 42*a*. As shown in FIG. 3, a portion of the media 22 is initially negatively charged by source 42*c* prior to movement of the portion of media 22 below source 42*a*. The positively charged satellites 34*a* are attracted to the target 44*a* comprising negatively-charged media 22 in the example of FIG. 3 which removes the satellites 34*a* from a suspended state in the region of air adjacent to media path 16. Other embodiments are possible, for example, where the source 42*c* emits positively charged ions and the source 42*a* emits negatively charged ions 43*a*. In some embodiments, an additional grounding structure 45*b* may be provided opposite of pen 30*a* as shown. In further example embodiments, grounded structures 45*a*, 45*b* may be implemented as a single continuous structure below media 22 as represented in phantom. In some arrangements, sufficient charge is present upon media 22 from source 42*c* and a power source to source 42*a* is not needed to emit ions 43*a* (e.g., source 42*a* may be implemented as a sharp edge or plural needles).

Referring to FIG. 4, another embodiment of print device 18*b* is shown. Print device 18*b* includes another embodiment of satellite removal system 40*b* configured to remove satellites 34*a*, 34*b* suspended in the air and resulting from the ejection of droplets 32*a*, 32*b* from nozzles 31*a*, 31*b*.

In the example embodiment of FIG. 4, satellite removal device 40*b* comprises a plurality of sources 42*a*, 42*b* which are configured to emit ions 43*a*, 43*b* of a common polarity (e.g., positively charged ions in the depicted example). Satellite removal device 40*b* also includes a plurality of collectors 46*a*, 46*b* which may be grounded to provide targets 44*b* for the positively-charged ions 43*a*, 43*b* and positively-charged satellites 34*a*, 34*b*. As shown in the example of FIG. 4, media 22 travelling along the media path 16 receives drops 32*a*, 32*b* of a liquid marking agent corresponding to an image being formed. Sources 42*a*, 42*b* are configured to emit the ions 43*a*, 43*b* which are attracted along field lines to the grounded collectors 46*a*, 46*b*. The ions 43*a*, 43*b* charge the satellites 34*a*, 34*b* which are subsequently also attracted to the collectors 46*a*, 46*b* to remove the suspended satellites 34*a*, 34*b* from a region of air adjacent to the media path 16. In other embodiments, sources 42*a*, 42*b* may emit negatively charged ions 43*a*, 43*b* which negatively charge the satellites 34*a*, 34*b*. Collectors 46*a*, 46*b* may be positively charged to attract the negatively charged ions 43*a*, 43*b* and satellites 34*a*, 34*b*.

The satellites 34*a*, 34*b* comprising liquid marking agent may collect at the collectors 46*a*, 46*b*. In one embodiment, the collectors 46*a*, 46*b* may individually comprise conductive grids and the satellites 46*a*, 46*b* may be collected upon the collectors 46*a*, 46*b*. In some arrangements, the satellite removal device 40*b* may remove liquid marking agent of the satellites 34*a*, 34*b* which has accumulated upon collectors 46*a*, 46*b*. In one embodiment, the collectors 46*a*, 46*b* may be heated to dry the liquid marking agent accumulated thereon to avoid the liquid marking agent from dripping upon the media 22 and to assist with evaporation of the liquid marking agent from the collectors 46*a*, 46*b*. Furthermore, a suction 48 may be provided for example by a vacuum in a direction upward and through collectors 46*a*, 46*b* to assist with removal of liquid marking agent from collectors 46*a*, 46*b*. The collectors 46*a*, 46*b* may be both heated and the suction 48 provided therethrough in some arrangements. In additional embodiments, the collectors 48*a*, 46*b* may be arranged vertically or in any other appropriate orientation to collect the satellites 34*a*, 34*b*.

The arrangement of FIG. 4 directs the satellites 34*a*, 34*b* upward away from the media 22 in the depicted embodiment. The arrangement of FIG. 4 may result in less unwanted background in the resulting hard images compared with the arrangements of FIGS. 2 and 3 since the satellites 42*a*, 42*b* are directed away from media 22.

Figure 5:
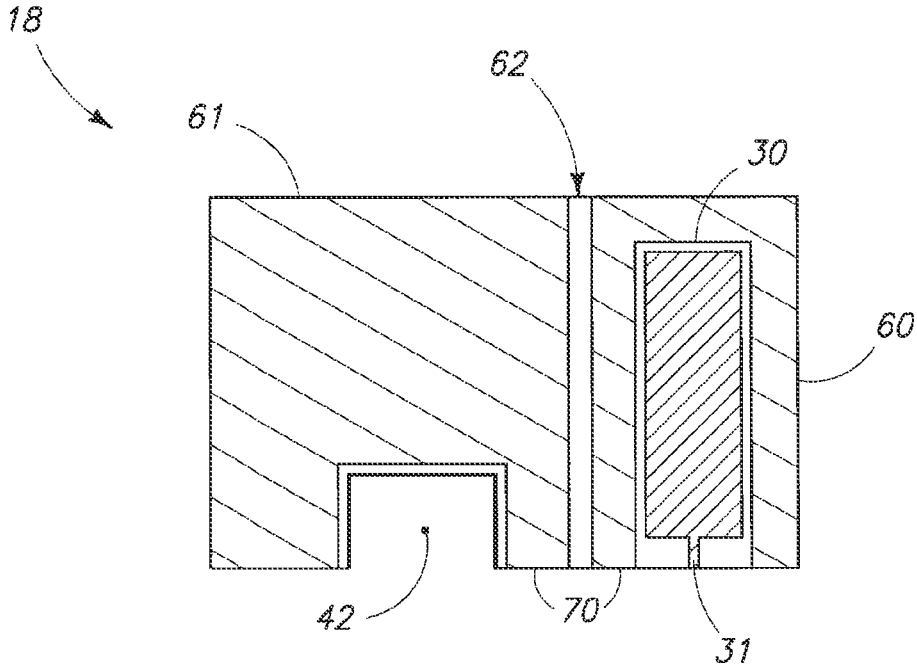
FIG. 5 is an illustrative representation of a print bar according one embodiment.

Referring to FIG. 5, one configuration of a print bar 60 of print device 18 is shown. The print bar 60 includes a housing 61 which houses pen 30 and source 42. The depicted configuration of print bar 60 illustrates one possible arrangement. In other embodiments, a plurality of rows of pens 30 and corresponding sources 42 may be provided in the print bar 60. The housing 61 of print, bar 60 includes a channel providing an air path 62. Movement of media 16 beneath print bar 60 draws a suction of air through air path 62 which draws satellites 30 away from pen 30 and from surface 70 between pen nozzle 31 and source 42 providing reduced accumulation of the liquid marking agent from the satellites 34 upon pen 30. Air path 62 has a diameter less than 1 mm in one embodiment.

At least some aspects of the disclosure describe methods and apparatus configured to remove satellites of liquid marking agent which are suspended in air in an imaging region adjacent to the print device. The removal of the satellites provides improved print quality during printing of numerous hard images compared with arrangements which do not remove satellites. In addition, utilization of an electrical field and charging of the satellites according to some of the example disclosed embodiments to remove the satellites may reduce or avoid a liquid marking agent from one of the pens cross-contaminating another of the pens (e.g., avoid or reduce a fixer from one pen contaminating a downstream ink pen in one example). Furthermore, the use of electrical fields to remove satellites does not affect hard images printed upon the media 22 compared with arrangements which rely upon suction to remove the satellites and which may alter hard images printed upon media. More specifically, a suction used to break the air boundary layer to remove suspended satellites may result in smearing of the hard images printed upon the media 22. At least some embodiments of the disclosure provide charging of satellites to direct the satellites through the boundary layer to the desired target without smearing hard images printed upon the media.

The protection sought is not to be limited to the disclosed embodiments, which are given by way of example only, but instead is to be limited only by the scope of the appended claims.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

The invention claimed is:

1. A hard imaging device comprising:

a media transport system configured to move media along a media path;

a print device adjacent to the media path and configured to eject a plurality of droplets of a liquid marking agent in a direction towards the media moving along the media path to form hard images using the media, the ejection of the droplets of the liquid marking agent from the print device creates satellites of the liquid marking agent suspended in air in a region adjacent to the print device and the media; and a satellite removal system comprising a charging device configured to electrically charge the satellites suspended in the air in the region adjacent to the print device and the media, and a target configured to attract the electrically charged satellites.

2. The device of claim 1 wherein the print device comprises a first pen and a second pen arranged in series at different locations along the media path and configured to eject the droplets of the liquid marking agent comprising different colors, wherein the second pen is downstream of the first pen in a direction of movement of the media along the media path, and wherein the satellite removal system is configured to remove the satellites, which resulted from the ejection of droplets of the liquid marking agent from the first pen, from the air before such satellites are adhered to the second pen.

3. The device of claim 1 wherein the target comprises a conductive structure positioned adjacent to the media path to attract the electrically charged satellites to the media.

4. The device of claim 1 wherein the target comprises a conductive structure spaced from the media path to attract the electrically charged satellites away from the media.

5. The device of claim 1 wherein the print device comprises a nozzle configured to eject the droplets of the liquid marking agent, and the satellite removal system comprises:

a first charging device upstream of the nozzle and configured to provide an electrical charge of a first polarity to the media; and a second charging device downstream of the nozzle and configured to provide an electrical charge of a second polarity to the satellites to cause the satellites to be attracted to the media.

6. The device of claim 1 wherein the print device comprises a pen configured to eject the droplets of the liquid marking agent and a housing comprising an air path configured to provide a flow of air to draw the satellites away from the pen during movement of the media along the media path.

7. A hard imaging device comprising:

a media transport system configured to move media along a media path;

a print device adjacent to the media path and configured to eject a plurality of droplets of a liquid marking agent in a direction towards the media moving along the media path;

a charging device configured to provide an electrical charge to satellites of the liquid marking agent suspended in air in a region adjacent to the print device and the media and which result from the ejection of the droplets of the liquid marking agent from the print device; and a target configured to attract the satellites which have been electrically charged.

8. The device of claim 7 wherein the target is positioned to attract the satellites which have been electrically charged to the media.

9. The device of claim 7 wherein the target is positioned to attract the satellites which have been electrically charged away from the media path and the media.

10. The device of claim 7 wherein the charging device is configured to provide the electrical charge having a first polarity, and further comprising another charging device configured to provide an electrical charge of a second polarity to the media which comprises the target.

11. The device of claim 7 wherein the print device comprises a pen configured to eject the droplets of the liquid marking agent and a housing comprising an air path configured to provide a flow of air to draw the satellites away from the pen during movement of the media along the media path.

12. A hard imaging method comprising:

ejecting a plurality of droplets of a liquid marking agent in a direction towards media to form a hard image on the media, the ejecting of the droplets suspending satellites of the liquid marking agent in air in a region adjacent to the media;

removing the satellites of the liquid marking agent from the air in the region adjacent to the media by electrically charging the satellites in the region adjacent to the media to facilitate directing the satellites out of the air; and receiving the droplets of the liquid marking agent upon the media to form the hard image, the hard image comprising the droplets of the liquid marking agent and the media.

13. The method of claim 12 wherein the ejecting comprises ejecting the droplets comprising different colors of the liquid marking agent using a plurality of nozzles arranged in series in a process direction, and wherein the removing comprises removing the satellites having one of the colors of the liquid marking agent from the air in the region adjacent to a first of the nozzles prior to the satellites having the one of the colors being drawn into another region of air adjacent to a second of the nozzles downstream from the first of the nozzles.

14. The method of claim 12 wherein the removing comprises directing the electrically charged satellites to the media.

15. The method of claim 12 wherein the removing further comprises electrically charging the media to have a first polarity, and wherein the electrically charging the satellites comprises electrically charging the satellites to have a second polarity opposite to the first polarity, and the directing comprises directing the electrically charged satellites having the second polarity to the media having the first polarity.

16. The method of claim 12 wherein the removing comprises directing the electrically charged satellites away from the media.

* * * * *